US008827301B2

(12) United States Patent
Vailli et al.

(10) Patent No.: US 8,827,301 B2
(45) Date of Patent: Sep. 9, 2014

(54) SNOW GLIDING BOARD STRUCTURE ELEMENT, AND GLIDING BOARD INCORPORATING SUCH AN ELEMENT

(71) Applicant: Skis Rossignol, Saint-Jean de Moirans (FR)

(72) Inventors: Johan Vailli, Coublevie (FR); Nicolas Puget, Novalaise (FR); David Bouvier, Coublevie (FR); Adrien Reguis, Grenoble (FR); Arnaud Repa, Le Fontanil Cornillon (FR)

(73) Assignee: Skis Rossignol, Saint-Jean de Moirans (FR)

( * ) Notice: Subject to any disclaimer, the term of this patent is extended or adjusted under 35 U.S.C. 154(b) by 0 days.

(21) Appl. No.: 13/693,491

(22) Filed: Dec. 4, 2012

(65) Prior Publication Data

US 2013/0140795 A1 Jun. 6, 2013

(30) Foreign Application Priority Data

Dec. 5, 2011 (FR) ..... 11 61177

(51) Int. Cl.
*A63C 5/052* (2006.01)
*A63C 5/12* (2006.01)
*A63C 5/00* (2006.01)

(52) U.S. Cl.
CPC ..... *A63C 5/006* (2013.01); *A63C 5/126* (2013.01); *A63C 5/12* (2013.01); *A63C 5/052* (2013.01)
USPC ..... 280/601; 280/609; 280/610

(58) Field of Classification Search
USPC ..... 280/601, 609, 610, 845, 14.1, 11.12, 280/841, 602; D21/760, 766, 771, 776
See application file for complete search history.

(56) References Cited

U.S. PATENT DOCUMENTS

| | | | | | |
|---|---|---|---|---|---|
| 2,581,532 | A | * | 1/1952 | Hem | 280/610 |
| 3,272,522 | A | * | 9/1966 | Kennedy, III | 280/610 |
| 3,352,566 | A | | 11/1967 | Kennedy | |
| 3,698,731 | A | * | 10/1972 | Jost et al. | 280/610 |
| 3,734,519 | A | * | 5/1973 | Bennett | 280/610 |
| 6,073,956 | A | * | 6/2000 | Zemke et al. | 280/610 |
| 6,082,747 | A | * | 7/2000 | Parmentier | 280/14.22 |

(Continued)

FOREIGN PATENT DOCUMENTS

| | | | | |
|---|---|---|---|---|
| EP | 0 034 643 | A1 * | 9/1981 | A63C 5/00 |
| EP | 0706411 | A1 | 4/1996 | |

(Continued)

OTHER PUBLICATIONS

Raw machine translation of Specification and Claims of WO 95/29743.*

(Continued)

*Primary Examiner* — J. Allen Shriver, II
*Assistant Examiner* — Steve Clemmons
(74) *Attorney, Agent, or Firm* — Harris Beach PLLC

(57) ABSTRACT

A snow gliding board, integrating a structure element incorporated in a raised end of said gliding board, said element having a plurality of hollowed through openings between its upper and lower surfaces, distributed across its surface, wherein said element comprises in said raised end at least one region free of through openings, separating two areas having through openings, the width of said region being greater than the shortest distance between two through openings in the areas separated by said region.

13 Claims, 4 Drawing Sheets

(56) References Cited

U.S. PATENT DOCUMENTS

| | | | | |
|---|---|---|---|---|
| 7,213,828 | B2 * | 5/2007 | Riepler et al. | 280/609 |
| 7,396,036 | B2 * | 7/2008 | Barbieri et al. | 280/601 |
| 7,487,991 | B2 * | 2/2009 | Degasperi et al. | 280/607 |
| 8,020,886 | B2 * | 9/2011 | Kirby | 280/601 |
| 8,215,659 | B2 * | 7/2012 | Binder | 280/601 |
| 2007/0194558 | A1 * | 8/2007 | Stone et al. | 280/601 |
| 2009/0134590 | A1 * | 5/2009 | Largueze et al. | 280/14.21 |
| 2010/0187795 | A1 * | 7/2010 | Binder | 280/601 |
| 2011/0023762 | A1 * | 2/2011 | Chen | 114/39.14 |

FOREIGN PATENT DOCUMENTS

| | | | |
|---|---|---|---|
| WO | WO 9515794 | A1 * | 6/1995 |
| WO | WO 9529743 | A1 * | 11/1995 |
| WO | WO-9901186 | A1 | 1/1999 |

OTHER PUBLICATIONS

Republique Francaise, Rapport De Recherche Preliminaire for Corresponding French Application No. FR1161177 in the French Language dated Jul. 1, 2012 (2 pgs).

* cited by examiner

-1-
2
3
4
6
7
8
9
10
11
14
15
16
L
21
22
23
24
26
27
28
29
30
31
32
40
41
42
43
80
81
82
83
84
90
91
92
93

SNOW GLIDING BOARD STRUCTURE ELEMENT, AND GLIDING BOARD INCORPORATING SUCH AN ELEMENT

CROSS-REFERENCE TO RELATED APPLICATIONS

This application claims the benefit of French Patent Application No. 1161177, filed on Dec. 5, 2011. The entirety of this application is incorporated herein by reference.

BACKGROUND

The present disclosure relates to the field of snow gliding sports, and especially relates to skis or snowboards. It more specifically aims at a structure element enabling to form boards having front and/or rear ends capable of being cut and which may be designed for lightening purposes or be partially translucent.

PRIOR ART

There is a general tendency to manufacturing gliding boards having an external aspect which clearly distinguishes them from competitor boards, for example, by providing visual effects due to the capacity of certain regions of the board of letting light pass through, and generally of being more or less translucent.

Different solutions have already been provided, and in particular those described in patent EP 0706411, which comprises forming a ski from elements forming longitudinal boxes, made of transparent material. However, the mechanical properties of such boards are directly dependent on the thicknesses of the walls of the different boxes, and for a high degree of transparency, it can be understood that the mechanical resistance may be insufficient.

Another example of this tendency is illustrated in document US 2010/0187795. The ski described in this document has a highly translucent tip. At the tip level, the central structure of the board is recessed, by an opening made in the core, or in a piece incorporated in the board, ahead of the core.

At this level, the board has a smaller thickness, and thus only comprises its upper assembly and its base, which are advantageously made of transparent material.

A disadvantage of this type of structure is that it generates stretchings of the upper assembly close to the recess borders, which stretchings may adversely affect the visual aspect, or may require the use of specific materials.

It should above all be noted that in this tip, the board structure is strongly lightened, which makes it less resistant.

Another observed tendency is the search for gliding boards which may be customized in terms of graphic design or even of shapes. Thus, certain users would like to be able to modify the end shape of their skis, at the tail or tip level, by making customized cuts.

SUMMARY

An object of the present invention thus is to enable to form gliding boards having original ends due to their capacity of being cut to take customized shapes. Further, another object is to obtain a lightened structure, or a degree of transparency of the structure.

To achieve this, the present invention thus relates to a gliding board integrating a structure element incorporated in a raised end of a gliding board, this element having a plurality of through openings hollowed between its upper and lower surfaces, distributed over the surface of this structure element.

According to the present invention, this element comprises at least one region free of through openings, this region separating two areas having through openings, the width of this region being greater than the shortest distance between two through openings in the areas separated by this characteristic region.

In other words, the present invention comprises forming an element which will be integrated in the ski structure and which has through, and thus empty, holes, thus providing a degree of lightening, or even of transparency, to the end of the concerned ski. Such an element has characteristic paths which extend between different points of the board periphery, to enable to perform cuttings between two separate points of the board periphery, as the user wishes.

Such characteristic regions have a sufficient length to be easily identified by the user who desires to perform the cutting, since the board ends are less translucent in these characteristic regions.

In practice, the shortest distance between two through openings is defined, within the areas located on either side of the region forming the cutting path, as being the shortest distance separating any two openings in the areas in question. In other words, due to this geometric configuration, the user can perform the cuttings without risking cutting a through opening, with the subsequent risk of forming a cavity where snow could build up, with a danger of delamination of the board structure at this level. In the case where the end is translucent due to the use of translucent layers on either side of the incorporated element, the user can easily visualize the area where he can perform the cutting.

In practice, the structure element may comprise one or several characteristic regions, with locations and geometries which may be defined in various ways, to increase cutting possibilities.

In practice, to make the characteristic regions clearly identifiable on the board, and to limit risks of cutting of a through opening, the minimum width of the characteristic regions should be greater than 8 millimeters, preferably around 15 mm.

In practice, different types of geometries of the regions separating the through opening areas can be observed according to whether the incorporated element is intended to equip the tip or the tail of the board.

Thus, in the case where the incorporated element is provided to be arranged at the tip, the regions free of through openings may have a substantially semi-circular geometry, having a curvature following the same direction as that of its front border. In other words, the regions where the cuttings will be performed have a geometry similar to the end of the board, to create a shorter tip flare after cutting. In practice, the regions free of through openings thus extend between two opposite edges of the incorporated element.

In an alternative embodiment, the region(s) free of through openings may define an inverted V shape, by extending all the way to the vicinity of the front edge of the element, to enable a pointed cutting of the tip.

In the more specific case intended for an incorporation in the board tail, the regions free of through openings may have a substantially rectilinear geometry, substantially oriented parallel to the longitudinal axis of the element and of the board, and which extends all the way to the rear edge of the incorporated element.

In other words, the geometry of the incorporated elements allows a cutting to form V- or arrow-shaped notches. In the specific case of the tail, this first region shape may also be combined with other semi-circular regions, enabling to perform cuttings aiming a decreasing the tail length.

In certain cases, a mass gain of the end incorporating the characteristic element, combining with the presence of the associated degree of transparency, is appreciated in certain cases. In practice, the degree of transparency and the mass gain are substantial as soon as the degree of perforation in the areas having the through openings is greater than 30%, or even 50%. "Degree of perforation" is used to designate the ratio of the total surface area of the openings to the surface of the area where the openings are present, by thus omitting the characteristic opening-free regions, as well as the periphery of the incorporated element.

The present invention also relates to a gliding board which incorporates the above-described structure element, and wherein the layers present above and under this incorporated element are advantageously translucent. It may especially be the upper assembly integrating the reinforcements and the protection and decoration elements, but also the base and the associated reinforcements, given that, in the ends, it is not always necessary to use reinforcing elements. In practice, the incorporated element extends from an area located beyond the front or rear contact line, and all the way to the front or rear end point of the board, or before this end point.

Advantageously, in practice, and in particular when the layers covering the characteristic incorporated element are not translucent, the gliding board may comprise a visual or tactile mark vertically above the regions free of through openings of the structure element, to ease the locating of the areas where cuttings should be performed.

BRIEF DESCRIPTION OF THE DRAWINGS

The implementation and other features and advantages of the present invention will be discussed in detail in the following non-limiting description of embodiments in connection with the accompanying drawings.

DESCRIPTION OF EMBODIMENTS

Figures 1, 2, 3:
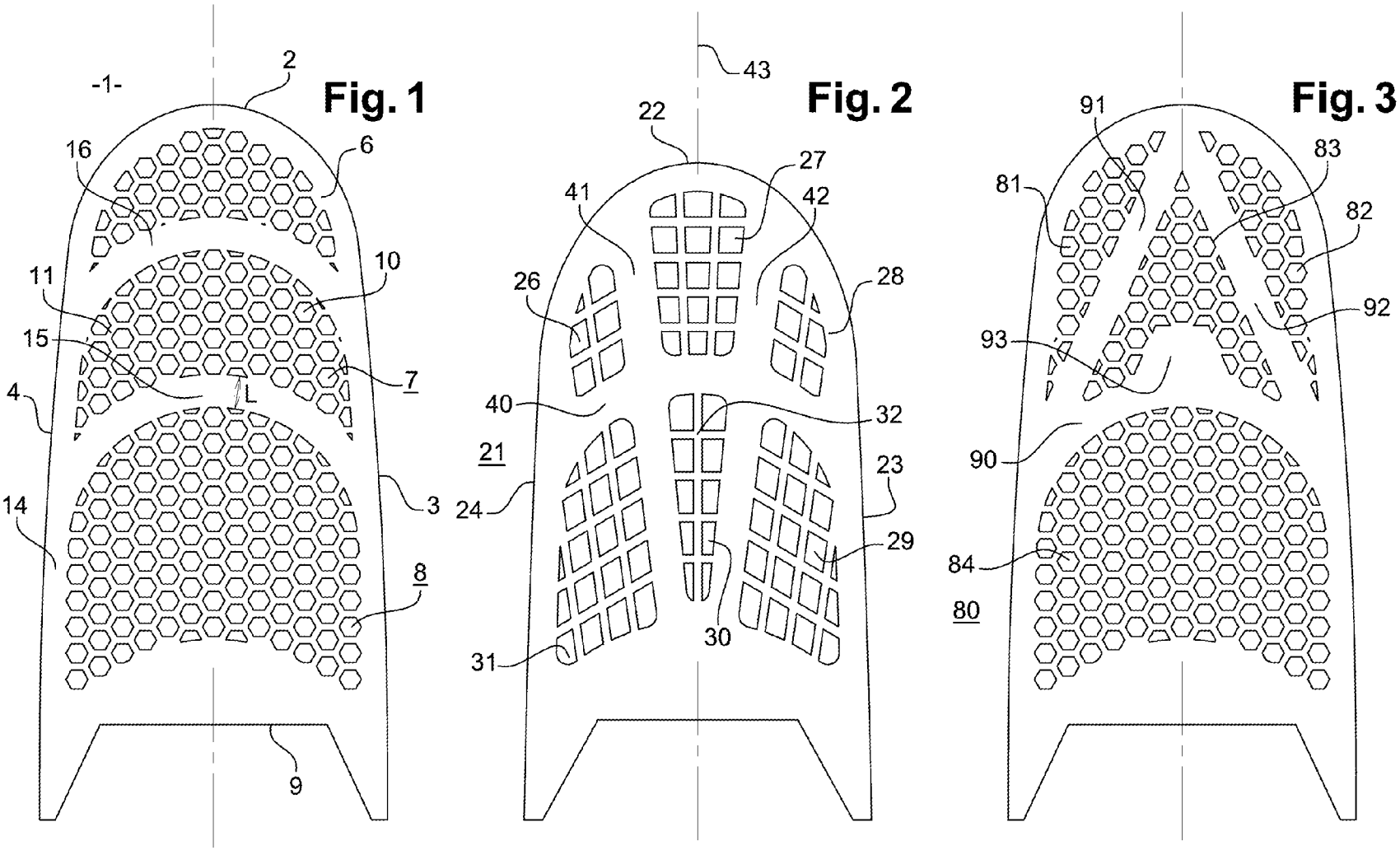
FIG. 1 is a top view of an incorporated element according to a first embodiment, more specifically intended for a use in a tip.
FIG. 2 is a top view of an incorporated element according to a second embodiment, more specifically intended for a use in a tail.
FIG. 3 is a top view of an incorporated element according to a third embodiment, more specifically intended for a use in a tip.

Incorporated element 1 illustrated in FIG. 1 has a generally elongated geometry with a front end 2 having the general shape of the board end. Thus, the two lateral edges 3, 4 may be flush and laterally emerge from the board in the case of a "sandwich"-type construction. This incorporated element may also not emerge laterally, but be lined with a complementary member, forming the board edge. Incorporated element 1 may also be used in the case of a "shell" structure, in which case it has slightly smaller dimensions than the finished board.

In the illustrated form, rear portion 9 of incorporated element 1 has a geometry which enables it to receive the front end of the core, while providing a thickness continuity.

In the form illustrated in FIG. 1, incorporated element 1 comprises three areas 6, 7, 8 having through openings 10. Such through openings have a hexagonal shape, defining together the portions of material. Of course, other square, circular, or the like shapes may be used without departing from the context of the present invention. The number of openings may be adapted according to the to geometry, and in particular to the size of the areas. The locating of the cutting area will be eased as soon as the number of openings is greater than or equal to three. The incorporated element may be made of a plastic material such as ABS, which may be a colored opaque or partially translucent material, for example, obtained by plastic injection. The incorporated element may be formed of several assembled parts, possibly made of different materials or having different colors. As a variation, the incorporated perforated element may have a decreased thickness, and for example be formed of a metal aluminum sheet, especially, and be associated with a hole-free layer.

In the illustrated form, the width of areas 11, measured between two parallel faces of two opposite hexagons is on the order of a few millimeters. These three areas 6, 7, 8 are surrounded with a hole-free peripheral area 14 which extends on the two sides 3, 4, front end 2 and rear end 9 of the incorporated element.

According to a feature of the present invention, this incorporated element comprises two regions 15, 16, which are free of through openings, and which define a privileged path for tip cuttings. Regions 15, 16 have a width L which is greater than the minimum width, separating openings 10 inside of the different perforated areas 6, 7, 8. Width L may range up to three times said minimum width, up to from 10 to 15 millimeters, approximately. Due to these dimensions, it is easy for the user to distinguish the cutting area with respect to the through hollowings.

The slightly semi-circular shape of characteristic regions 15, 16 is provided to enable to cut the ski by re-forming a shorter tip, having a curvature similar to that of front edge 2 of the incorporated element. Characteristic regions 15, 16 extend from one edge to the other 3, 4 of the incorporated element to enable to cut element 1 without reaching a through opening. It is indeed preferable to avoid creating compartments where snow or water could be stored, with risks of infiltration between the different layers forming the board structure. It is thus advantageous to cut the board and thus the incorporated element in a hole-free area, to keep the board tight after the cutting.

Incorporated element 21 illustrated in FIG. 2 is more specifically intended to be integrated in the tail portion of the board. It has, in the illustrated form, six perforated areas 26-31. The through openings have approximate quadrilateral shapes enabling to increase the degree of opening or of perforation by limiting the volume of material used to form separations 32 between through openings. In the form illustrated in FIG. 2, element 21 comprises a region 40 free of through openings, which has a geometry substantially similar to that of the equivalent regions used for the incorporated element of the tip area of FIG. 1, with a semi-circular shape. Element 21 also comprises two areas 41, 42 free of through openings, of rectilinear geometry, arranged symmetrically with an angle of inclination with respect to axis of symmetry 43 of element 21. Regions 41, 42 extend around two perforated areas 27, 30, enabling to define a hollowing of trapezoidal or triangular shape at the tail level.

FIG. 3 illustrates an alternative embodiment of incorporated element 80 which has four through opening areas. A first area 84 is arranged symmetrically with respect to the median longitudinal axis, in the region located on the board center side. This area is similar to area 8 of element 1 of FIG. 1. Area 84 extends towards the front all the way to a region 90 free of through openings, enabling to cut the tip according to an arc of circle offset towards the rear with respect to the board periphery before cutting. Further towards the front, incorporated element 80 comprises three through opening areas. Two areas 81, 82 are laterally arranged outside of two areas 91, 92 free of through openings, directed towards the front-end point of the board. The two areas 91, 92 enable to cut the tip to provide it with a more pointed shape than that of the board before cutting. Between cutting areas 91, 92, is located another area 83 comprising through openings, of generally triangular shape. Area 83 is delimited at the back by cutting area 90. In the particular illustrated form, the back of perforated portion 83 comprises an outgrowth 93 of cutting area 90, located on the longitudinal axis. Outgrowth 93 defines a region of sufficient dimensions to enable to drill a hole such as made in touring skis.

Figure 4:
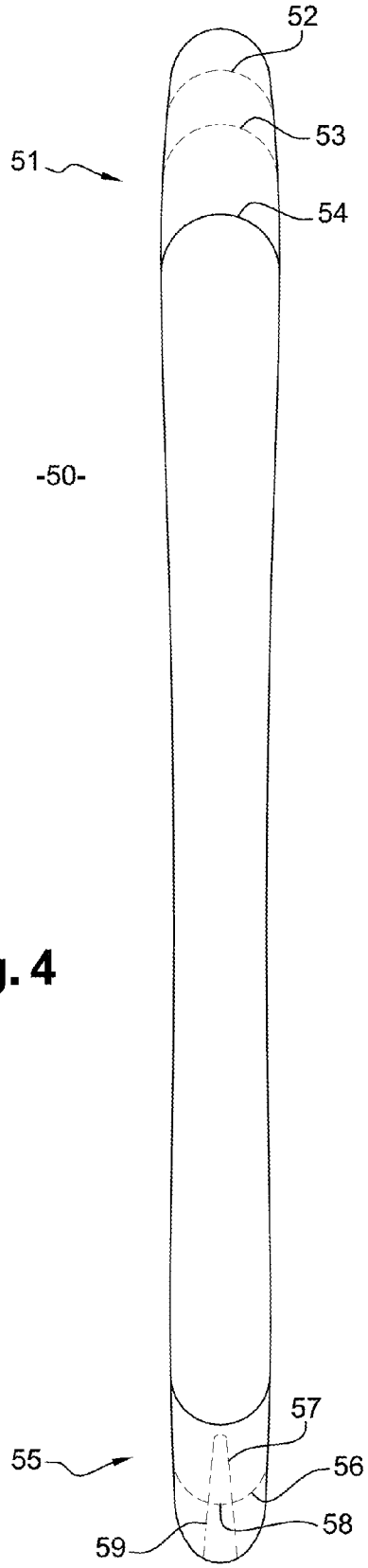
FIG. 4 is a top view of a ski integrating the two elements of FIGS. 1 and 2.

FIG. 4 shows the different cutting possibilities with a board integrating the two elements 1, 21 of FIGS. 1 and 2. Thus, board 50 may, at the level of its tip area 51, be cut along dotted lines 52, 53 of the incorporated element, which stops at the level of full line 54. Similarly, at the level of tail area 55, different cuttings may be performed above dotted line 57 to form an arrow shape, which may be smaller if the cuttings are performed along dotted lines 59 and transverse portion 58. In the same way as for the tip area, semi-circular dotted line 56 may enable to decrease the tail length.

Figure 5:
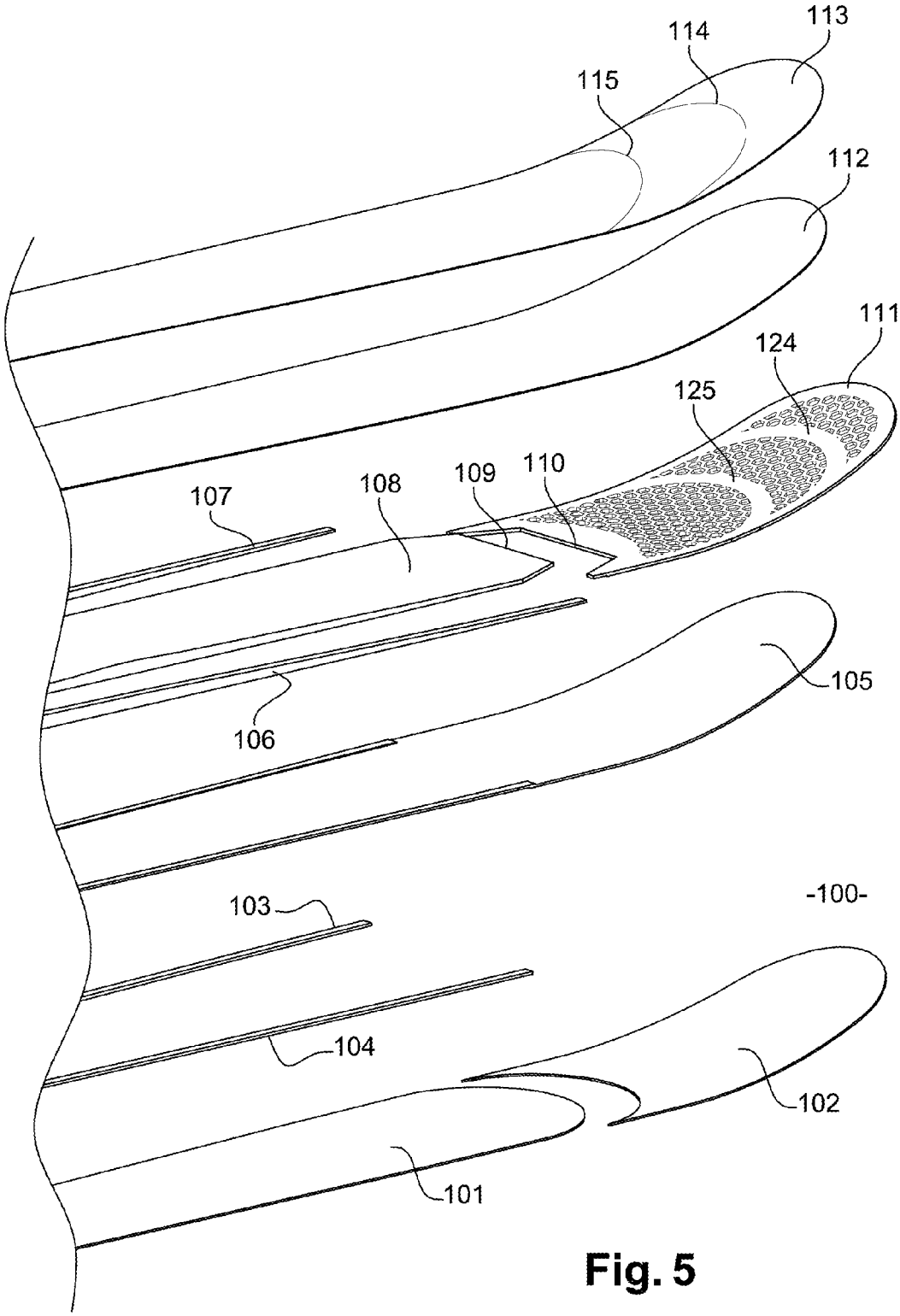
FIGS. 5 and 6 are simplified perspective views showing the ends of gliding boards in exploded view, respectively at the top and at the tail, the different elements forming it being separated.

The incorporated element described in FIG. 1 may be integrated in a gliding board structure in different ways, in particular, as illustrated in FIG. 5 where the incorporated element extends in line with the core. In this case, and starting from the lower surface, the structure comprises a base 100, formed of a main element forming the gliding base 101 and of a base element 102 which is advantageously translucent to take advantage of the capacity of the incorporated element to let light pass through. Base 100 laterally receives edges 103, 104, and a reinforcing element 105. Above reinforcing element 105 are arranged edges 106, 107 lining core 108 having its front cut 109 receiving rear edge 110 of incorporated element 111. In the illustrated form, incorporated element 111 extends all the way to the board end, but it may stop before. As an indication, according to the board geometry and in particular to the shape of the tip raising, the incorporated element may have a length ranging between approximately 70 and 400 mm.

This stack is covered with a reinforcing element 112 and with an upper decoration and protection layer 113. This last layer 113 may advantageously have marks 114, 115 located upstream of regions 124, 125 free of through openings of incorporated element 111, which are useful in the case where the end assembly is not translucent, to guide the user as accurately as possible during the cutting. Such marks may be made by printing, or by recessed or raised areas.

It should be noted that if reinforcement elements 112 containing a fibrous material impregnated with a resin which flows during molding operations, it is possible for part of this resin to partially penetrate into the characteristic through openings, without however filling them.

Preferably, reinforcement elements 105, 112 and upper decoration layer 113, as well as the front portion of base 102, are made of a translucent, or even transparent material, to let part of the light capable of crossing incorporated element 111 pass through.

Figure 6:
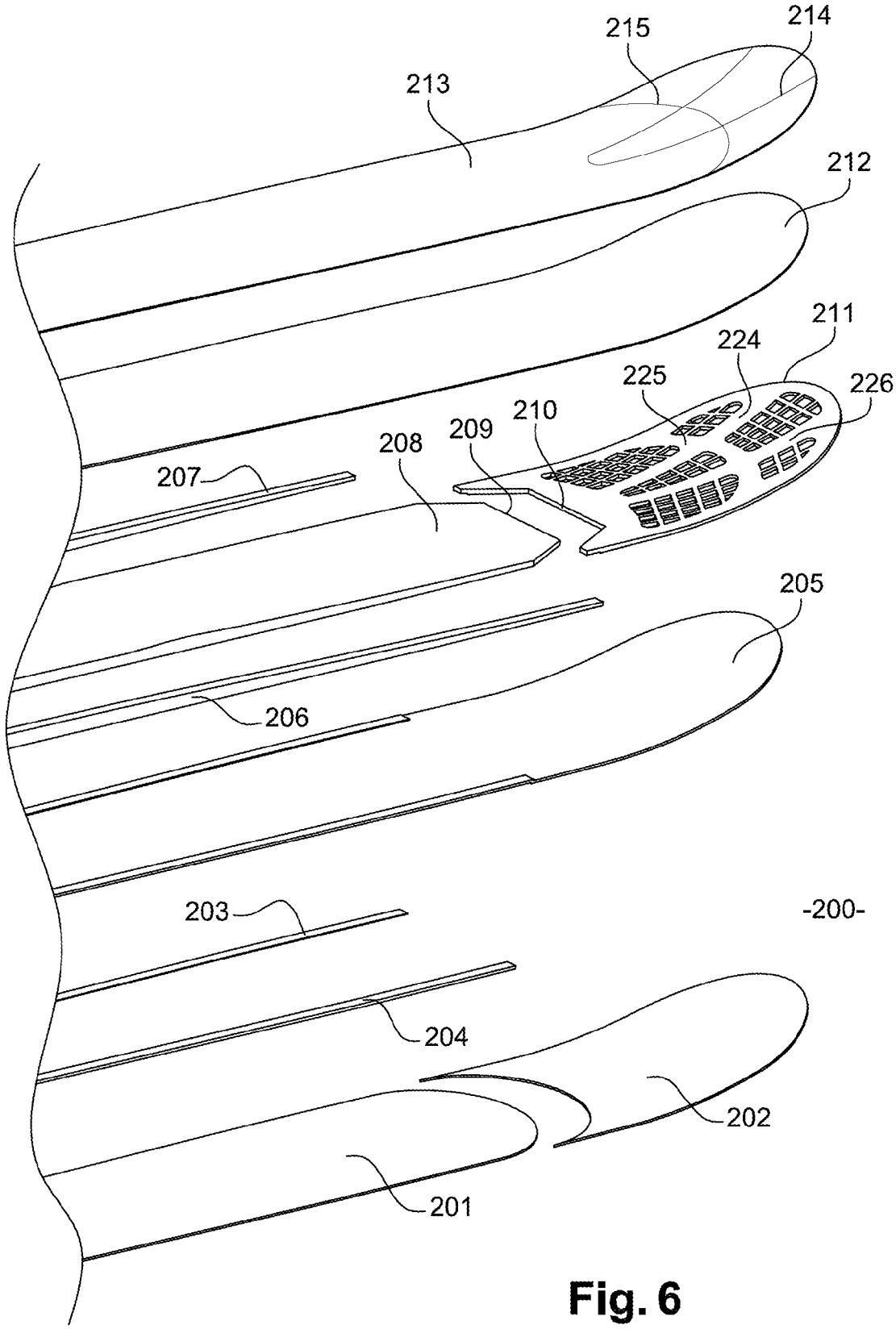

Of course, multiple variations relating to the board construction as concerns the number of layers used, the types of reinforcement and their positioning may be implemented without departing from the framework of the present invention. Thus, similarly, as illustrated in FIG. 6, the rear portion of the board may be formed of base 200 which comprises, at the back of actual gliding base 201, a translucent portion 202. Edges 203 and 204 are supported by the base edges and are covered with reinforcing layer 205. Said layer receives edges 206, 207 which line the rear end of core 208 having a contour 209 which integrates in cutting 210 performed in incorporated element 211. A reinforcement 212, preferably translucent, covers the core and incorporated element 211 and in turn receives upper protection layer 213, also translucent, having marks 214, 215 formed thereon above areas 224, 225, 226 free of through openings in incorporated element 211. Similarly, many alternative constructions and geometries may be achieved without departing from the framework of the present invention.

As appears from the foregoing, the use of the incorporated element according to the present invention enables to form boards which have both an attractive visual aspect, being translucent at their tip and tail ends, while enabling to customize their shape by cuttings which may be performed with no risk of damaging the board structure, even when performed by a user equipped with basic tools. It also enables to obtain lightened ends with the same customized cutting possibilities.

The invention claimed is:

1. A snow gliding board, integrating a structural element incorporated in a raised end of said gliding board, said element having a plurality of hollowed through openings between its upper and lower surfaces, distributed across its surface, wherein said structural element comprises in said raised end at least one region free of through openings, separating two areas having through openings, the width of said region being greater than the shortest distance between two through openings in the areas separated by said region, said region configured to guide a cutting operation to remove at least one area of said structural element having through openings from said snow gliding board, without cutting through one or more of said plurality of hollowed through openings.

2. The gliding board of claim 1, wherein the width of said region free of through openings is greater than 8 mm.

3. The gliding board of claim 1, wherein the region(s) free of through openings have a substantially semi-circular geometry, having a curvature following the same direction as that of a front border of the snow gliding board.

4. The gliding board of claim 1, wherein the region(s) free of through openings extend between two opposite edges of said element.

5. The gliding board of claim 1, wherein the region(s) free of through openings have a substantially rectilinear geometry, substantially oriented parallel to a longitudinal axis of the element and of the element, and extending all the way to a rear edge of said element.

6. The gliding board of claim 1, wherein the region(s) free of through openings define an inverted V shape, and extend all the way to the vicinity of a front edge of said element.

7. The gliding board of claim 1, wherein in the areas having through openings, the degree of perforation is greater than 30%.

8. The gliding board according to claim 1, wherein the gliding board further comprises layers present above and under said structural element and said layers are translucent.

9. The gliding board according to claim 8, wherein the incorporated structural element extends from a point located beyond a front or rear contact line of the gliding board, all the way to a front or rear end of the board.

10. The gliding board according to claim 1, comprising a visual or tactile mark above the regions free of through openings of the structural element.

11. The gliding board according to claim 10, wherein the incorporated structural element extends from a point located beyond a front or rear contact line of the gliding board, all the way to the front or rear end of the board.

12. The gliding board of claim 1, wherein said region is configured to guide a cutting operation which prevents a delamination of one or more layers of said snow gliding board caused by an exposure of a cut edge of said one or more of said plurality of hollowed through openings to snow.

13. The gliding board of claim 1, wherein said region is configured to guide a cutting operation which prevents a delamination of one or more layers of said snow gliding board caused by a formation of a cavity where snow could build up.

* * * * *